US011691312B2

(12) United States Patent
Miki et al.

(10) Patent No.: US 11,691,312 B2
(45) Date of Patent: Jul. 4, 2023

(54) METHOD OF MOLDING PLANT-BASED MATERIAL AND MOLDED BODY

(71) Applicant: NATIONAL INSTITUTE OF ADVANCED INDUSTRIAL SCIENCE AND TECHNOLOGY, Tokyo (JP)

(72) Inventors: Tsunehisa Miki, Aichi (JP); Masako Seki, Aichi (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 1176 days.

(21) Appl. No.: 16/071,223

(22) PCT Filed: Jan. 24, 2017

(86) PCT No.: PCT/JP2017/002329
§ 371 (c)(1),
(2) Date: Jul. 19, 2018

(87) PCT Pub. No.: WO2017/130957
PCT Pub. Date: Aug. 3, 2017

(65) Prior Publication Data

US 2021/0170625 A1 Jun. 10, 2021

(30) Foreign Application Priority Data

Jan. 27, 2016 (JP) ..... 2016-012904

(51) Int. Cl.
*B27M 1/00* (2006.01)
*B27M 1/02* (2006.01)
(Continued)

(52) U.S. Cl.
CPC ..... *B27M 1/00* (2013.01); *B27M 1/02* (2013.01); *B27N 3/28* (2013.01); *B27N 5/00* (2013.01)

(58) Field of Classification Search
CPC . B27M 1/00; B27M 1/02; B27M 3/00; B27N 3/28; B27N 5/00
See application file for complete search history.

(56) References Cited

FOREIGN PATENT DOCUMENTS

| | | |
|---|---|---|
| JP | 2001-26005 | 1/2001 |
| JP | 2002-146195 | 5/2002 |

(Continued)

OTHER PUBLICATIONS

International Search Report dated May 9, 2017 in International Application No. PCT/JP2017/002329.

*Primary Examiner* — S. Behrooz Ghorishi
(74) *Attorney, Agent, or Firm* — Wenderoth, Lind & Ponack, L.L.P.

(57) ABSTRACT

In order to provide a method of molding plant-based material to mold three-dimensional shape of cross section for relatively long plant-based material while maintaining the continuity of original cell/tissue of the plant-based material by means of simple equipment and process, we obtained a long plant-based material of high density and high strength by continuously giving compressing/drawing deformation to the component tissue of the plant-based material toward the center direction while extruding the plant-based material via the extruding die having a prescribed extrusion ratio and die angle for a relatively long plant-based material long in the fiber direction.

6 Claims, 6 Drawing Sheets

Extrusion Die (heating: softening temperature of cedar)
Extrusion ratio: 2.6 (reduction in area: 62 %)

(51) Int. Cl.
*B27N 5/00* (2006.01)
*B27N 3/28* (2006.01)

(56) References Cited

FOREIGN PATENT DOCUMENTS

| | | | | |
|---|---|---|---|---|
| JP | 2003-145511 | | | 5/2003 |
| JP | 2003145511 | A | * | 5/2003 |
| JP | 2003-231101 | | | 8/2003 |
| JP | 2003231101 | A | * | 8/2003 |
| JP | 2004-9567 | | | 1/2004 |
| JP | 2006-76055 | | | 3/2006 |
| JP | 2008036941 | A | * | 2/2008 |
| JP | 2011-161835 | | | 8/2011 |

* cited by examiner

METHOD OF MOLDING PLANT-BASED MATERIAL AND MOLDED BODY

ART FIELD

This invention concerns a method of molding plant-based material and molded body, in more detail, a method to push a long plant-based material into a die having an optional extrusion ratio (reduction in area) and a die angle and fix a form by shearing/compressing the tissue/cell of the plant-based material toward the cross-sectional direction of longer shaft while crushing the void and continuously forming.

This invention is to provide a new molding art for a comparably long plant-based material such as wood or bamboo, the use of which is highly expected as a substantial renewal resource, into a three-dimensional shape of an optional cross-section, while maintaining the original continuity of the tissue/cell of the plant-based material, by means of simple equipment and process.

BACKGROUND ART

The plant-based material such as wood and bamboo is renewable and draws attention as a material to replace plastics produced using petroleum, a buried resource.

In order to mold these plant-based materials into a desired shape, there are proposed such methods as a method to mold a plate-like wood through uniaxial pressurizing using a set of concave/convex dies (refer to patent literature 1), as for compression-molded wood or exterior material of electronic equipment using it, method to mold a comparably long (bar-like) wood through uniaxial pressurizing with a set of dies (refer to patent literature 2), and a method to mold lignocellulose/thermoplastic resin complex material or wooden thermosetting resin material using as a method to provide fluidity to them by mixing thermoplastic resin or thermosetting resin into disintegrated wood and pour it into the dies and cool/harden it (refer to patent literatures 3 and 4).

But in the method to mold a plate-like or bar-like plant material by pressurizing it from one direction with multiple concave/convex dies, disclosed in the patent literature 1, if a long product having symmetrical cross-section such as a round bar, is molded, destruction will occur on the free surface without contact with the die in the uniaxial pressurizing process or if the amount of material supplied is not appropriate, molding failure will occur due to insufficient filling or burrs will be produced due to excessive supply of the material, thus failing to provide a good compressed state on a prescribed cross-section.

In the molding method disclosed in the patent literature 2, it is necessary to have concave/convex dies equivalent to the size of the plant material and press equipment having a large press plate for uniaxial pressurizing to deform the cells by compressing.

For this reason, the size was restrictive and there was a problem that shapes to be produced are limited and continuous molding was impossible.

In the method disclosed in the patent literatures 3 to 4 using fine powder as the material, a lot of time and energy is required to make the powder of the plant-based material, and depending on the resin to be mixed/kneaded, there are such problems as deterioration in mechanical and physical properties attributable to the dispersibility and compatibility with the plant based powder, and design deterioration or increased environmental load.

PRIOR ART LITERATURE

Patent Literature

[Patent Literature 1] JP 2006-076055 A
[Patent Literature 2] JP 2004-009567 A
[Patent Literature 3] JP 2011-161835 A
[Patent literature 4] JP 2002-146195 A

OUTLINE OF INVENTION

Problems to be Solved by the Invention

Under such circumstances, in consideration of the above conventional arts, the inventors have endeavored to accumulate studies aiming at developing new molding arts of plant-based materials to realize continuous molding while realizing a good compressed state of cell/tissue structure even for a long material by a simple means and method without using special equipment or process from plant-based materials such as wood and bamboo, while realizing a cross-section of cell/tissue structure, which can securely solve the problems of the above conventional arts, and as a result, they molded by extruding/drawing in a die having a prescribed extrusion ratio and die angle and provided the cross-sectional shape by deforming the component cells by shearing and installing, as required, a jig of required cross-sectional shape (for example, bearing (including those which gradually change in combination with the die in this specification) constant in cross-sectional dimensions provided for the die) after making the entire plant-based material supplied to the die into a compressed and shored state, and found out that they could obtain a symmetrical cross-sectional shape of a round bar, for example, which is smooth on the surface without cracking, high in density and strength while maintaining continuity of tissue/cell of the long plant-based material, to complete this invention.

This invention has the objective of providing a manufacturing method of new molded body of plant-based materials such as wood and bamboo, and the molded body. This invention also has the objective of providing a molded product having the long compression-molded body made by the above method of manufacturing and reflecting on the molded body the original feeling of the plant-based material such as wood and bamboo to maintain the continuity of the tissue structure.

Means to Solve Problems

In order to achieve the above object, the method of molding the plant-based material of this invention is characterized in that it obtains a long plant-based material in such a way that the outer edge portion is higher in density and strength than the inside portion over the entire circumference by giving compressing/drawing deformation to the component tissue of the plant-based material long in the fiber direction, impregnated with thermosetting resin, continuously in the center direction of the material while extruding the material via the heated die having a prescribed extrusion ratio (reduction in area) and die angle.

In this case, it is possible to form it into an optional shape while maintaining the continuity of the longitudinal fiber by installing a jig provided with changes in cross section in the longitudinal direction in the rear of the die.

It is also possible to do hot forming by impregnating the plant-based material with resin material prior to molding.

It is also possible for the plant-based material to be supplied to the die as a single material or aggregate of multiple bulks before molding.

It is also possible to control the weight of molded body obtained and the balance by forming a hole in the longitudinal direction of the plant-based material before molding, adjusting the reduction in area in the longitudinal direction when molding, and causing distribution of bulk density in the longitudinal direction after molding.

It is also possible to arrange a dissimilar material inside the molded body through integral molding by forming a hole in the plant-based material in the longitudinal direction before molding and incorporating the dissimilar material in the hole.

The molded body of the plant-based material obtained by the molding method of a plant-based material of this invention consists of a long plant-based material, and the component tissue of the plant-based material is compressed in the center direction from the entire circumference of the wooden material and the thermosetting resin impregnated in the plant-based material is hardened and is characterized in that the outer edge portion is made higher in density and strength than the inside portion over the entire circumference.

Effect of the Invention

By the molding method and molded body of plant-based material of this invention, the following effects can be obtained.

(1) It can provide a simple and efficient method of high-density molding of plant-based material and molded body.

(2) Even if the plant-based material before molding is single material or divided or separated into multiple materials, they can be integrated in the molding process.

(3) By working on the cross section of the plant-based material before molding, it is possible to control the long molded body and mechanical properties such as density distribution in the axial direction and strength distribution.

(4) Since the plant-based material used in this invention is a plant-based material, a renewal resource, it can basically solve the environmental issue and waste problems.

(5) It can provide a compression-molded body maintaining continuity of fibrous cell of the plant-based material molded using the plant-based material as the material.

EMBODIMENTS OF THE INVENTION

Figure 1:
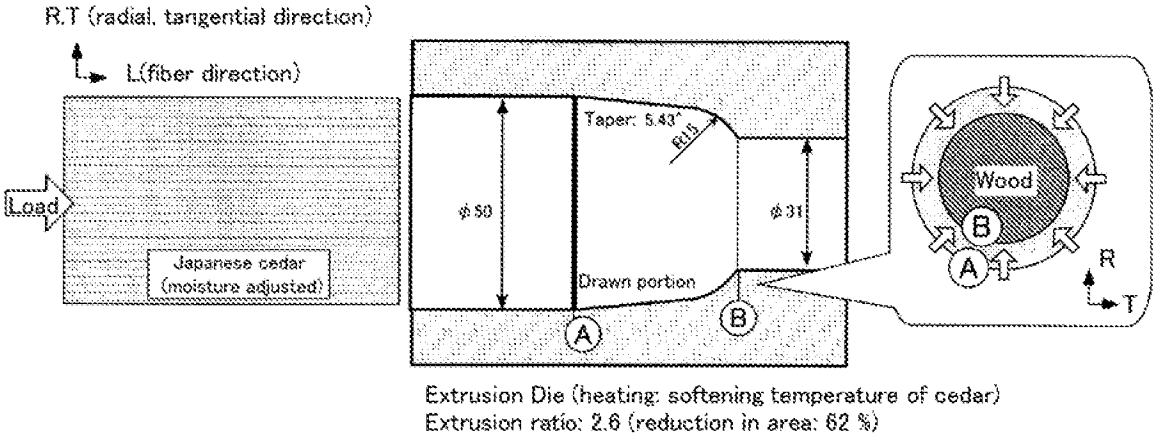
FIG. 1 Explanatory drawing to show Embodiment 1 of the molding method of plant-based material of this invention FIG. 2 Picture to show one example of the molded body (molded product) of the plant-based material of this invention FIG. 3 Picture to show one example of molded body (molded product) of the plant-based material of this invention FIG. 4 Picture to show one example (pierced material) of molded body (molded product) of the plant-based material of this invention FIG. 5 Picture to show one example (dissimilar material/joint) of molded body (molded product) of the plant-based material of this invention FIG. 6 Picture to show one example (long drawing/compression-molded body) of molded body (molded product) of the plant-based material of this invention

The embodiments of the molding method and molded body of the plant-based material of this invention are explained below in accordance with the drawings.

This invention is a method to manufacture the molded body by molding a long plant-based material by applying compression force at the compression stress place, characterized in that the plant-based material is pressed into the die having a prescribed extrusion ratio (reduction in area) and die angle and a long molded body, high in density and high in strength is obtained by extruding while drawing (reducing the area) by compression/shear deforming in the forwarding direction within the die, further characterized in that the desired long molded body high in density and high strength having an optional cross section and bulk density distribution in the axial direction is obtained by arranging a jig such as bearing for shape fixing at the die exit.

In this invention, a preferred embodiment of the invention is that the plant-based material be supplied to the die as a single material or bulk body of multiple materials and by impregnating the plant-based material before molding with resin, the moldability be controlled and the mechanical and physical properties of the molded body be controlled.

In this invention, another preferable embodiment is that the entire bulk density and cross-sectional bulk density distribution be controlled while securing the continuity of the cell/tissue near the surface of the molded body obtained by controlling the compression/drawing deformed state by properly selecting the extrusion ratio and die angle of the die to be used, that the plant-based material impregnated with resin before molding be molded with a heated die, the mechanical and physical properties of the molded body be improved by adjusting the die temperature, molding speed, moisture content of the material, resin type, resin concentration and distribution, and furthermore, the feeling of the grain of the material be reflected on the molded body, that the plant-based material be wood or bamboo, long molded body high in density and having an optional cross-sectional shape and bulk density distribution in the axial direction be manufactured, and furthermore, that the plant-based material be continuously supplied to the die.

As aforementioned, this invention is a method to manufacture the molded body by deforming the long plant-based material by applying the shearing force at the compression stress place, characterized in that the plant-based material is pushed into the die having a prescribed extrusion ratio (reduction in area) and die angle and a long molded body high in density and high in strength is obtained by extruding while drawing (reducing the area) by compression/shear deforming the component cell in the forwarding direction within the die, and furthermore, characterized in that the desired molded body high in density and high in strength having an optional cross-sectional shape and bulk density distribution in the axial direction is obtained by arranging a jig such as bearing for shape fixing at the die exit.

This invention is a method to obtain the molded body having an optional cross-sectional shape and bulk density in the axial direction by extruding and compression/drawing molding the plant-based material, and in this case, any molding method for pushing the material into the die is applicable, and for example, the rearward extruding molding method to mold by deforming the material in the direction opposite to the pressurizing direction and forward extruding molding method to mold by deforming the material in the same direction as the pressurizing direction are illustrated, and it is not limited to this, and molding methods equivalent or similar to these and any other molding method capable of extruding molding can be used.

In this invention, the plant-based material means renewable organic resources synthesized by plants using solar energy, water, soil and air.

The plant-based materials of this invention are not limited in particular, and this invention can be applied for plant-based materials in general, for example, to be specific, wood, bamboo, grass, trees and agricultural wastes are illustrated as preferable materials.

The method of manufacturing the molded body of this invention is a method of manufacturing the molded body by deforming a long plant-based material by applying shearing force at the compression stress place, and the plant-based material is pushed into the die having a prescribed extrusion ratio (reduction in area) and die angle and since the material is extruded while being drawn (cross section being reduced), the component cell is compression/shearing deformed in the forwarding direction within the die, the deformation of the material mainly proceeds near the die. For this reason, it is also possible to control the weight of the molded body obtained and the balance by forming a hole in the cross section of wood or in the longitudinal direction of the plant-base material before molding and adjusting the diameter, length and shape and adjusting the reduction in cross section (extrusion ratio) in the longitudinal direction when molding, thus causing the bulk density distribution in the longitudinal direction after molding.

Even if the plant-based material before molding is divided or separated into multiple pieces, they are integrated after molding by molding them with a connecting member inserted in the hole described above, and therefore, it is possible to supply the plant-based material as a single or multiple bulk bodies to the die and bearing, and the manufacturing method of plant-based material of this invention can be applied in the same way even if the plant-based material is a single piece or divided or separated into multiple pieces.

It is also possible to obtain a hollow molded body by utilizing the hole formed in the cross section (cross section of wood) of the plant-based material before molting or in the longitudinal direction of the plant-based material and using in combination such extruding tool as mandrel.

If the manufacturing method of molded body of this invention is applied for a plant-based material having fibrous structure, it is possible to have the molded body maintain the original fibrous structure because the fiber is hardly destructed in the molding process.

Since the fibrous structure of the molded body surface is consolidated and smoothed equivalent to the die surface property, it is possible to improve the strength reliability by improving the crude density, a strength defect.

The following will explain the method of manufacturing the molded body of the plant-based material in this invention. In this invention, it is a major feature to obtain a desired molded body by pushing the plant-based material into a die having a prescribed extrusion ratio (reduction in cross section) and die angle and compression/shearing deforming the component cell in the forward direction within the die and extruding while drawing (reducing the cross section).

In case of the manufacturing method of molded body of this invention, the material deformation is held to the compression stress place just under the die due to die restriction, and so the occurrence of tensile stress, a factor for destruction, is prevented and since the shape is formed by giving shearing/compression deformation of the cell, good high-density deforming becomes possible in comparison with the molding method utilizing uniaxial compression, conventionally used for ordinary plate-like wood and bar-like wood.

In case of the uniaxial compression, the tensile stress occurs to the vertical direction in the compression process, and this induces the occurrence of defects such as cracking, and if the supply amount of material is not proper, molding failure due to insufficient filling occurs, and if the supply amount is excessive, due to occurrence of burrs and good molding is impossible.

If this molding is done using, for example, Japanese cedar, coniferous wood, as the plant-based material, the die (extrusion ratio: 2.6, die angle 5.45, die R 15 mm) is heated to 100 C or higher, and the method to push the cedar with moisture adjusted into there is illustrated.

Here, as the material of dies, it is possible to use hard metallic material such as stainless steel used as material of dies and inorganic material in addition to the SKD (alloy tool steel (dies steel)) such as SKD11 used in this embodiment.

The cedar loaded in the axial (fiber) direction is pushed into the die and molded receiving the deformation to reduce the cross section while receiving the compressive force in the forward direction from the die contact surface.

Figure 2:
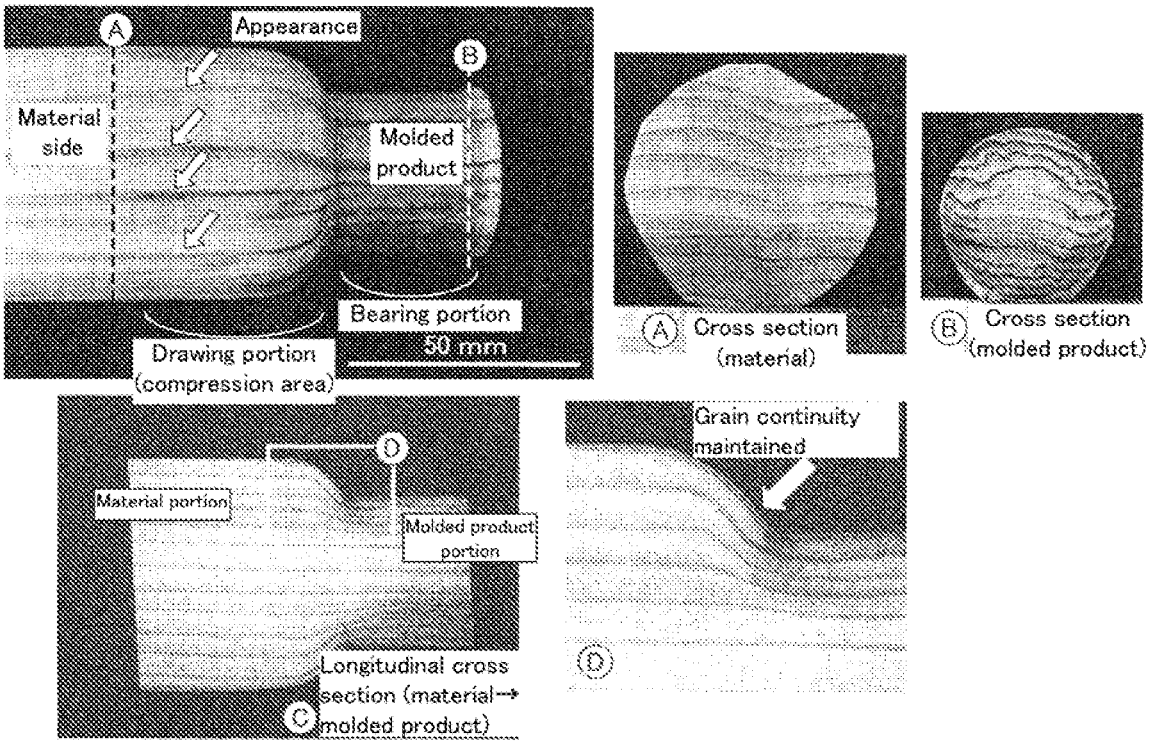

Finally with the cedar 50 mm in diameter, a molded body is obtained as high-density round bar after drawn to diameter 31 mm (FIG. 2).

In FIG. 2, the continuity of grain is confirmed as shown by the arrow as appearance from the material to the molded product, and in the longitudinal direction, forming to a round cross-sectional shape is completed with the continuity of fiber in the longitudinal direction maintained while giving cross-sectional changes to the longitudinal direction.

The grain confirmed in the material cross section A before molding is narrower in interval in the cross section B of the molded product, becoming higher in density (especially the degree of compression is higher near the molding surface).

With the manufacturing method of molded body of this invention, the properties of the molded body can be optionally controlled by setting the die temperature, state of die surface finished, extruding speed, moisture in material and resin impregnation.

The surface of the molded body with the resin setting completed in the heated drawing with the die surface at the exit mirror-finished, for example, using the surface impregnated material of thermosetting resin, is very hard, smooth and glossy while reflecting the original grain of the-plant-based material.

Even under similar die conditions, the thickness of high-density layer of the molded body surface can be changed or the load required for molding can be reduced as required, by increasing the die temperature and extruding speed.

With the conventional molding method of plant-based material, it was difficult to continuously compress and process a long molded body having an optional cross section by supplying the plant-based material such as bamboo and wood to the die for uniaxial press and reflecting the feeling of the raw material on the molded body.

On the contrary, this invention can form a long object theoretically infinitely long by continuously pushing a long plant-based material into the die when the plant-based material is pressurized and compressed.

By adding the plant-based material as required, it is also possible to splice simultaneously with the molding, thus making it possible to continuously manufacture a long molded body.

With this invention, in order to manufacture a long compressed and molded body by compressing and drawing the plant-based material, preferably a molding means consisting of a die shown in FIG. 1 having an optional molding die angle and extrusion ratio into which the material is pushed and pressurized and bearing portion for shape fixing and equipment provided with pressurizing means and heating means attached to it are used, and the size of them, specific shape, structure and shape of the cross section for molding can be optionally designed in accordance with the target product.

By drawing the molded body from the rear of the die, it is possible to prevent occurrence of buckling of the plant-based material before molding and to reduce the extruding load.

Further, with this invention, the molding conditions including the type of the plant-based material, shape and size of the plant-based material to be supplied to the die, the moisture content, extruding load, and temperature/time can be optionally set in accordance with the type of the plant-based material, cross-sectional shape and structure of the molded body, type of deep bottom and required feeling of the material.

The method of this invention is a method known as the molding method utilizing plasticity of the material and conventionally it is a molding method to be applied for materials of high plasticity and high fluidity and had been considered not applicable for such plant-based materials as bamboo and wood, and the inventors of this method made various investigations under the conditions of molding pressure, temperature, moisture content of the material, and processing time, and as a result, we found out that the molded body can be manufactured into optional forms while maintaining the feeling of the material even for these plant-based materials and have established it as a new molding art of plant-based materials.

Then we explain this invention specifically in accordance with the embodiments of this invention below, but this invention is not to be limited to the following embodiments.

Embodiment 1

From the cedar (coniferous wood), we roughly processed to cut the material for the size 50 mm in diameter which can be inserted in the die and immersed it in water to create surface moisture state and supplied it for the experiment. For the extrusion molting, we used the forward extrusion molding method by means of a die having a prescribed die angle, extrusion ratio and bearing length (FIG. 1).

We inserted one piece of material into the die heated to 150 C, pushed it directly into the heated die with the press, pressurized, and deformed it.

Subsequently we took out the heated material without cooling the die and obtained the drawn/compressed molded body (FIG. 2) with the cross-sectional shape reduced from 50 mm to 31 mm.

The time required for molding was about 10 seconds.

The molded product portion was hardly discolored maintaining the continuity of the grain as shown in FIGS. 2 C and D.

Embodiment 2

From the cedar (coniferous wood), we cut out the material roughly processed to the size 50 mm or less in diameter, impregnated it about 38% with phenolic resin, extruded and supplied it for the experiment.

For the extrusion molding, we used the forward extrusion molding method by means of a die having a prescribed die angle, extrusion ratio and bearing length.

We inserted one piece of material into the die heated to 180 C, pushed in the material directly with the press, pressurized and deformed it.

Subsequently, we cooled the die and took out the pressurized material and obtained the drawn/compressed molded body with the cross-sectional shape reduced from 50 mm to 31 mm.

The molded product portion had smooth surface and gloss and was hardened maintaining the continuity of grain.

Embodiment 3

Figure 3:
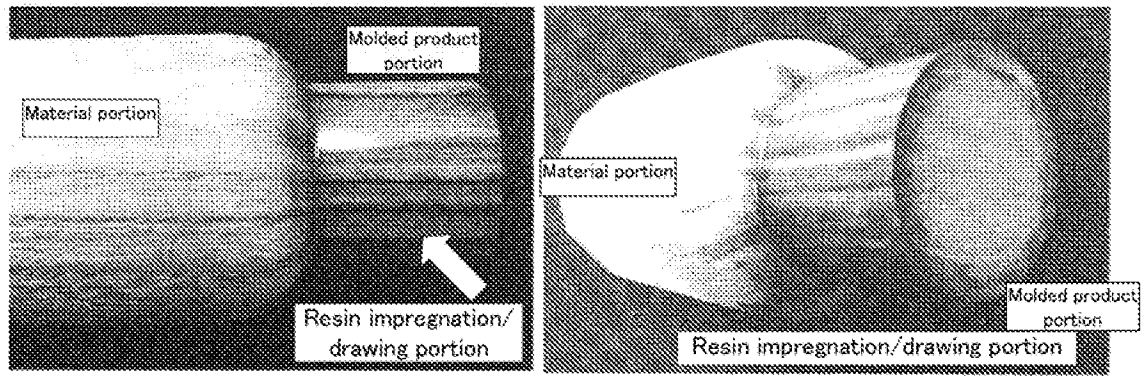

From paulownia (broad-leaved tree), we roughly processed to the 50 mm in diameter which can be inserted in the die and cut out the material and impregnated about 22% with phenolic resin, extruded and used it for the experiment. For the extrusion molding, we used the forward extrusion molding method by means of a die having a prescribed die angle, extrusion ratio and bearing length (FIG. 3).

We inserted one piece of material into the die heated to 180 C, pushed the material directly into the die with the press, pressurized and deformed it.

Subsequently, we cooled the die and took out the molded body and obtained the drawn/compressed molded body with the cross-sectional shape reduced from 50 mm to 31 mm.

The molded body had smooth surface and gloss and was hardened maintaining the continuity of the grain.

Embodiment 4

Figure 4:
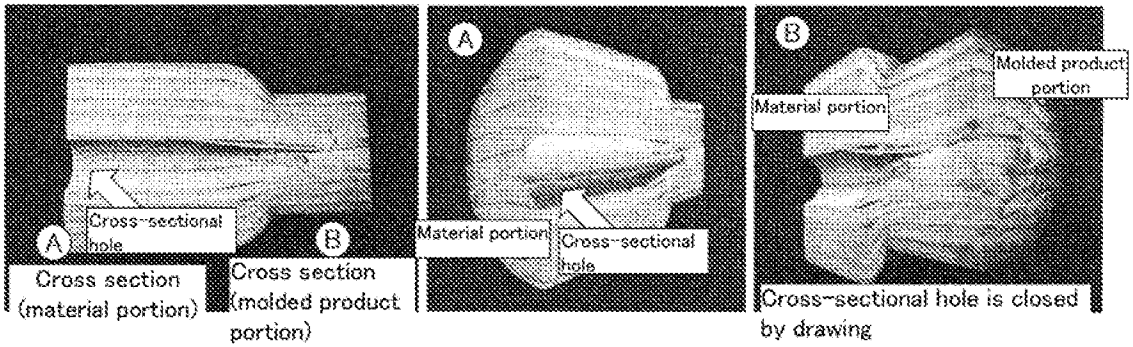

From cedar (coniferous wood), we roughly processed to the size 50 mm or less in diameter which can be inserted in the die and cut out the material and made a through hole in the longitudinal direction near the center of the cross section, impregnated it about 38% with phenolic resin, extruded and used it for the experiment (FIG. 4).

For the extrusion molding, we used the forward extrusion molding method by means of a die having a prescribed die angle, extrusion ratio and bearing length.

We inserted one piece of material into the die heated to 180 C, pushed in the material directly with the press, pressurized and deformed it.

Subsequently, we cooled the die and took out the molded body with the cross-sectional shape reduced from 50 mm to 31 mm closing the hole initially provided as it was drawn and compressed.

By adjusting the size of this hole and the depth in the longitudinal direction, we can obtain a long wooden material different in the density distribution in the longitudinal direction (weight per unit volume) the surface of the molded product of the same diameter having smooth surface and gloss and being hardened maintaining the continuity of the grain.

Embodiment 5

From cedar (coniferous wood), we roughly processed to the size 50 mm or less in diameter that can be inserted into the die and cut out the material, made a through hole in the longitudinal direction near the center of the cross section, impregnated the material about 38% with phenolic resin, extruded and used it for the experiment.

For the extrusion molding, we used the forward extrusion molding method by means of a die having a prescribed die angle, extrusion ratio and bearing length.

Figure 5:
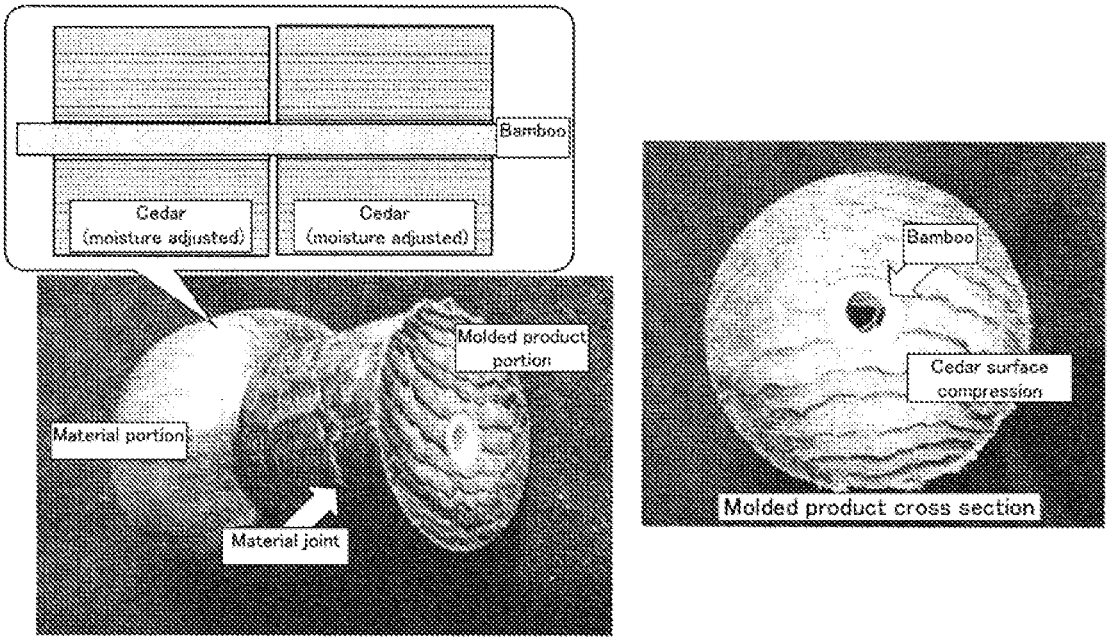

We inserted two pieces of material into the die heated to 180 C (material of 50 mm in length with bamboo inserted in the through hole), pushed in the material directly with the press, pressurized and deformed it (FIG. 5).

Subsequently, we cooled the die and took out the pressurized material and obtained the drawn/pressurized molded body with the cross section reduced from 50 mm to 31 mm and the two pieces of material spliced in the longitudinal direction.

On the cross section of the molded product portion, the bamboo and cedar are in good contact with the bamboo's flexibility given to the drawn/compressed cedar and with the surface of the molded product portion having smooth surface and gloss and hardened maintaining the continuity of cedar grain.

By repeating such system, a long wooden product not limited in length can be obtained.

Embodiment 6

Figure 6:
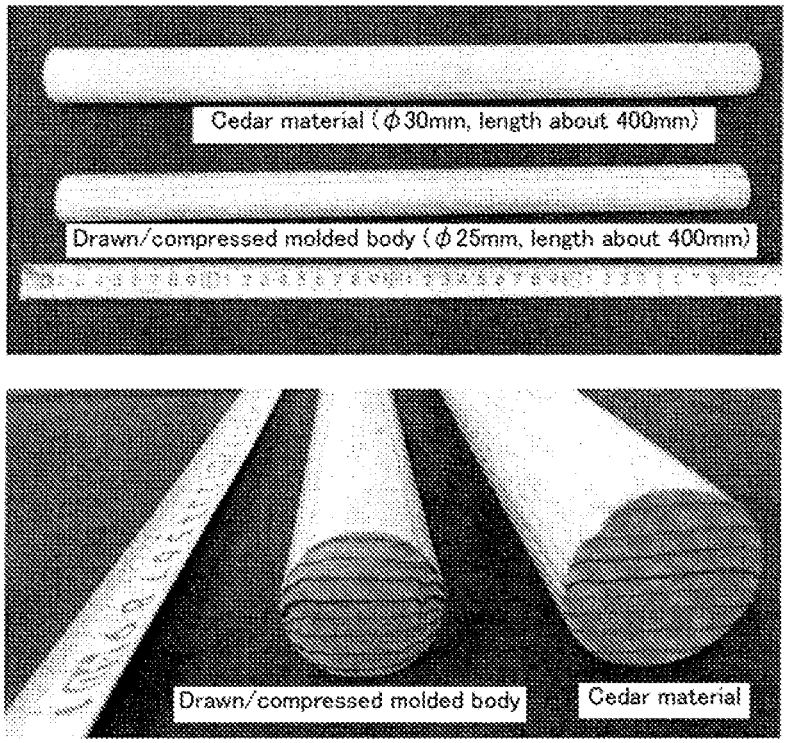

From cedar (coniferous wood), we roughly processed to the size about 30 mm in diameter that can be inserted into the die (exit diameter 24 mm) and extruded and used the material for the experiment. At that time, we used the bearing of 25 mm in inside diameter and 500 mm in length and obtained the long drawn/compressed molded body shown in FIG. 6. The extrusion ratio was 1.44 (reduction in cross section: 31%).

The cross section of the molded product was subjected to compression from the circumferential direction and high density was obtained at the surface portion. The surface of the molded product had smooth surface and gloss and was hardened maintaining the continuity of the cedar grain.

Industrial Application

As described above, this invention concerns the method of molding the plant-based materials and the molded body, and it is possible to manufacture and provide compressed molded body of an optional cross section with the mechanical/physical properties controlled in the long axial direction by pushing a long plant-based material into the die having a prescribed extrusion ratio (reduction in cross section) and die angle and continuously molding and extruding/drawing molding while crushing void by searing/compressing the tissue and cell of the plant-based material and extruding/compressing to fix the shape.

The invention claimed is:

1. A method of molding a plant-based material, consisting of impregnating a surface of a plant-based material with a thermosetting resin, extruding the plant-based material in a longitudinal fiber direction via an extrusion die heated to 100° C. or higher and having a prescribed extrusion ratio, a die angle and a bearing portion for cylindrical shape fixing, by giving compressing/drawing deformation to a component tissue of the plant-based material continuously in a center direction of the plant-based material to achieve higher density and higher strength, and further optionally, before extruding, making a hole in the longitudinal fiber direction of the plant-based material, and adjusting a reduction in cross section in the longitudinal fiber direction when extruding to cause a bulk density distribution in the longitudinal fiber direction after molding, and controlling the weight and balance of a molded body obtained from the plant-based material, or further optionally, before extruding, making a hole in the longitudinal fiber direction of the plant-based material and incorporating dissimilar materials in the hole, and performing integral molding to arrange the dissimilar materials inside a molded body obtained from the plant-based material.

2. The method of molding the plant-based material according to claim 1, wherein an optional shape is formed while maintaining continuity of the fiber in the longitudinal fiber direction by arranging a jig provided with cross-sectional changes to the longitudinal fiber direction at a rear of the extrusion die.

3. The method of molding the plant-based material according to claim 1, wherein the plant-based material comprises a single material or an aggregate of multiple bulk bodies.

4. The method of molding the plant-based material according to claim 1, wherein the method further includes, before extruding, making the hole in the longitudinal fiber direction of the plant-based material, and adjusting the reduction in cross section in the longitudinal fiber direction when extruding to cause the bulk density distribution in the longitudinal fiber direction after molding, and controlling the weight and balance of the molded body obtained from the plant-based material.

5. The method of molding the plant-based material according to claim 1, wherein the method further includes, before extruding, making the hole in the longitudinal fiber direction of the plant-based material and incorporating dissimilar materials in the hole, and performing integral molding to arrange the dissimilar materials inside the molded body obtained from the plant-based material.

6. The method of molding the plant-based material according to claim 1, wherein the extrusion die is heated to 180° C.

* * * * *